US009639015B2

(12) United States Patent
Morales-Tirado et al.

(10) Patent No.: US 9,639,015 B2
(45) Date of Patent: May 2, 2017

(54) EMULSION AGGREGATION TONERS

(71) Applicant: XEROX CORPORATION, Norwalk, CT (US)

(72) Inventors: Juan A. Morales-Tirado, Henrietta, NY (US); David J. W. Lawton, Stoney Creek (CA); Edward G. Zwartz, Mississauga (CA); Vincenzo G. Marcello, Webster, NY (US); Yolanda E. Maldonado, Webster, NY (US); David R. Kurceba, Hamilton (CA)

(73) Assignee: XEROX CORPORATION, Norwalk, CT (US)

( * ) Notice: Subject to any disclaimer, the term of this patent is extended or adjusted under 35 U.S.C. 154(b) by 118 days.

(21) Appl. No.: 14/102,319

(22) Filed: Dec. 10, 2013

(65) Prior Publication Data

US 2015/0160574 A1 Jun. 11, 2015

(51) Int. Cl.

*G03G 9/00* (2006.01)
*G03G 9/08* (2006.01)
*G03G 9/087* (2006.01)

(52) U.S. Cl.

CPC ..... *G03G 9/0825* (2013.01); *G03G 9/0804* (2013.01); *G03G 9/0827* (2013.01); *G03G 9/08711* (2013.01)

(58) Field of Classification Search

CPC ..... G03G 9/00; G03G 9/0827; G03G 9/08708
USPC ..... 430/110.2, 108.8, 109.1, 110.3
See application file for complete search history.

(56) References Cited

U.S. PATENT DOCUMENTS 3,590,000 A 6/1971 Palermiti et al.
3,800,588 A 4/1974 Larson et al.
4,298,672 A 11/1981 Lu
4,338,390 A 7/1982 Lu
5,853,943 A 12/1998 Cheng et al.
5,916,725 A 6/1999 Patel et al.
6,120,967 A 9/2000 Hopper et al.
6,214,507 B1 4/2001 Sokol et al.
7,704,662 B2 * 4/2010 Kmiecik-Lawrynowicz et al. ..... 430/109.4
7,785,763 B2 8/2010 Agur et al.
2005/0136352 A1 * 6/2005 Vandewinckel ..... G03G 9/0806 430/107.1
2008/0107989 A1 5/2008 Sacripante et al.
2010/0196604 A1 * 8/2010 Kariya ..... C09D 11/322 427/288
2011/0318685 A1 12/2011 Vanbesien et al.
2012/0021351 A1 * 1/2012 Mang ..... G03G 9/0804 430/137.14
2012/0052429 A1 * 3/2012 Wosnick ..... G03G 15/2092 430/105
2012/0258398 A1 10/2012 Zhou et al.
2013/0029261 A1 * 1/2013 Jang et al. ..... 430/108.11

OTHER PUBLICATIONS

David John William Lawton, et al., U.S. Appl. No. 13/850,654, filed Mar. 26, 2013, entitled Emulsion Aggregation Process, USA.
Juan A. Morales-Tirado, et al., U.S. Appl. No. 14/051,837, filed Oct. 11, 2013, entitled Emulsion Aggregation Toners, USA.

* cited by examiner

*Primary Examiner* — Thorl Chea

(74) *Attorney, Agent, or Firm* — Pillsbury Winthrop Shaw Pittman LLP

(57) ABSTRACT

Disclosed is toner particles having controlled and tailorable fusing characteristics. In particular, there is provided toner particles comprising styrene acrylate which have specific shape characteristics that allow for tailorable fusing characteristics without generating a detrimental effect on the blocking characteristics of such toners.

13 Claims, 3 Drawing Sheets

EMULSION AGGREGATION TONERS

CROSS-REFERENCE TO RELATED APPLICATIONS

Reference is made to U.S. application Ser. No. 13/850,654, filed Mar. 26, 2013, entitled "Emulsion Aggregation Process," with the named inventors David John William Lawton, David R. Kurceba, Frank Ping-Hay Lee, Daniel McDougall McNeil, and Santiago Faucher, the disclosure of which is totally incorporated herein by reference.

Reference is made to U.S. application Ser. No. 14/051,837, filed Oct. 11, 2013, entitled Emulsion Aggregation Toners, with the named inventors Juan A. Morales-Tirado, David John William Lawton, and Vincenzo G. Marcello, the disclosure of which is totally incorporated herein by reference.

BACKGROUND

Disclosed herein is a toner prepared by a continuous emulsion aggregation process that exhibits improved gloss and fusing characteristics.

Numerous processes are within the purview of those skilled in the art for the preparation of electrophotographic toners. Emulsion aggregation (EA) is one such method. Emulsion aggregation techniques entail the formation of an emulsion latex of the resin particles by heating the resin using emulsion polymerization as disclosed in, for example, U.S. Pat. No. 5,853,943, the disclosure of which is totally incorporated herein by reference.

Two exemplary emulsion aggregation toners include acrylate based toners, such as those based on styrene acrylate toners as illustrated in, for example, U.S. Pat. No. 6,120,967, and polyester toners, as disclosed in, for example, U.S. Pat. No. 5,916,725, U.S. Pat. No. 7,785,763, and US-2008/0107989, the disclosures of each of which are totally incorporated herein by reference.

Over the last several years there has been an increasing trend in the toner industry towards toner designs that require lower energy to fix. To provide lower fixing energy, manufacturers have been moving towards toner designs that use polyester resins instead of styrene acrylate resins. Polyester technology has enabled designs with lower energy consumption during the fusing process. One drawback of polyester toner designs, however, is the high cost of the polyester latexes. Accordingly, it would be desirable to optimize the viscoelastic properties of styrene acrylate toners to enable lower fusing energy requirements. Doing so, however, would entail changes to the properties of some of the raw materials or replacing some of the raw materials for others. The challenge is to enable the benefit in the fusing performance of the toner while maintaining all other functional properties unchanged.

Accordingly, while known compositions and processes are suitable for their intended purposes, a need remains for toner particles having controlled and tailorable rheology properties. In addition, a need remains for toner particles having controlled and tailorable fusing characteristics. Further, a need remains for toner particles for which the particle shape can be tailored independently of the toner rheology. Additionally, a need remains for toners having the above noted advantages that are prepared by continuous emulsion aggregation methods. There is also a need for toners having the above noted advantages that are prepared by efficient methods in terms of time and energy. Additionally, a need remains for toners having tailorable fusing characteristics without generating a detrimental effect on the blocking characteristics of such toners.

SUMMARY

Disclosed herein is a toner composition comprising particles which comprise: a styrene acrylate resin; a wax; and an optional colorant, wherein the toner particles have a circularity of from about 0.940 to about 0.999, the toner particles contain wax domains having an aspect ratio of from about 1.4 to about 1.8, and the toner particles contain wax domains having a roundness of from about 1.3 to about 1.6.

In another embodiment, there is provided a toner composition comprising: toner particles comprising a styrene acrylate resin; at least one wax; and an optional colorant; and a shell disposed over the toner particles, wherein the toner particles have a circularity of from about 0.940 to about 0.999, the toner particles contain wax domains having an aspect ratio of from about 1.4 to about 1.8, and the toner particles contain wax domains having a roundness of from about 1.3 to about 1.6.

There is further provided a method of forming a toner composition comprising: (a) forming a slurry comprising particles by preparing an emulsion comprising: (1) a latex of at least one polymer resin; (2) a wax dispersion; (3) optionally a colorant dispersion; and (4) optional additives dispersions; (b) aggregating particles from the slurry; (c) optionally adding a second polymer latex and further aggregating the particles to form a shell on the particles; (d) freezing aggregation of the particles; (e) preheating the slurry of aggregated particles; (f) increasing the pH of the slurry of aggregated particles; (g) coalescing the aggregated particles to form toner particles by continuously passing the aggregated particles through a system comprising at least one heat exchanger; (h) and optionally increasing the pH of the slurry of coalesced toner particles subsequent to passing through the system; and (j) recovering the toner particles from the system, wherein the toner particles have a circularity of from about 0.940 to about 0.999, the toner particles contain wax domains having an aspect ratio of from about 1.4 to about 1.8, and the toner particles contain wax domains having a roundness of from about 1.3 to about 1.6.

DETAILED DESCRIPTION

Figure 1:
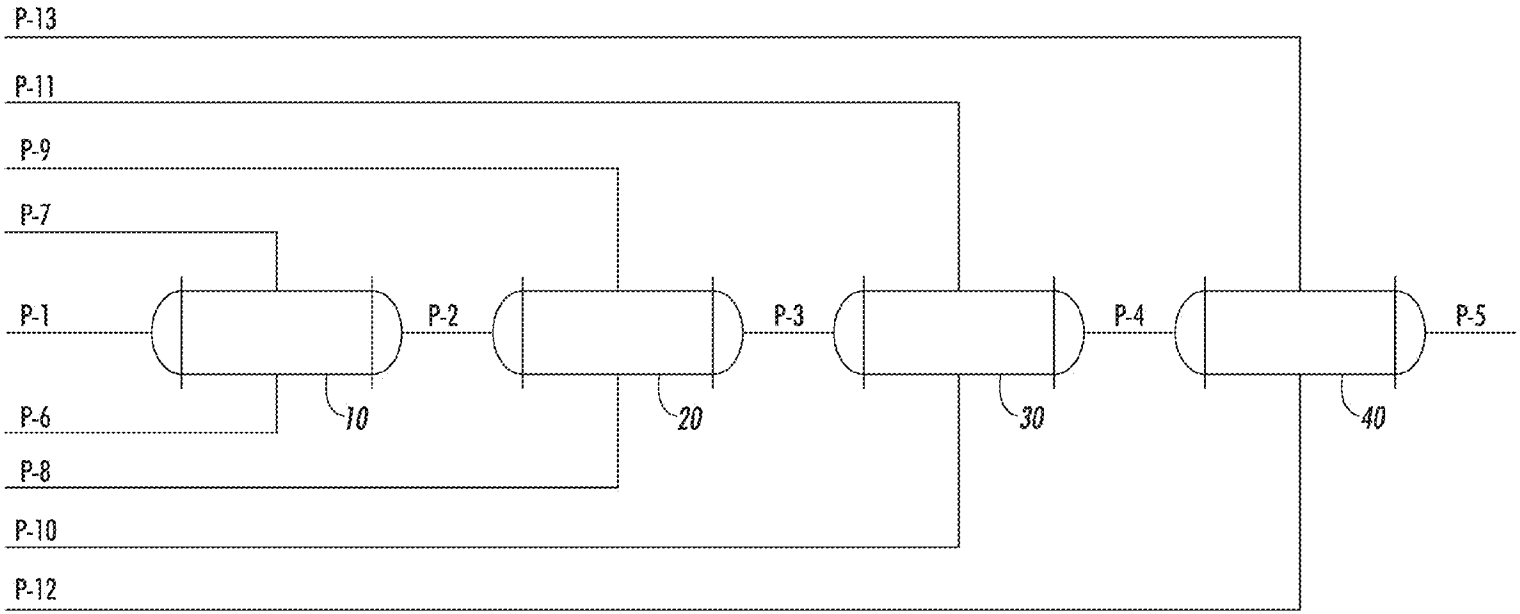
FIG. 1 illustrates a system incorporating four heat exchangers for carrying out ramp/coalescence in an emulsion aggregation process.

The toners disclosed herein are emulsion aggregation toners that can be prepared from any desired or suitable resins suitable for use in forming a toner. Such resins, in turn, can be made of any suitable monomer or monomers. Suitable monomers useful in forming the resin include styrenes, acrylates, methacrylates, butadienes, isoprenes, acrylic acids, methacrylic acids, acrylonitriles, mixtures thereof, and the like.

Examples of suitable resins include polyolefins, polyethylene, polybutylene, polyisobutyrate, ethylene-propylene copolymers, ethylene-vinyl acetate copolymers, polypropylene, and the like, as well as mixtures thereof. Specific examples of resins which can be used include poly(styrene-acrylate) resins, crosslinked poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, crosslinked alkali sulfonated poly(styrene-butadiene) resins, and the like, as well as mixtures thereof.

Examples of other suitable latex resins or polymers which can be used include poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butylacrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butylacrylate-isoprene); poly(styrene-propyl acrylate), poly(styrene-butylacrylate), poly(styrene-butadiene-acrylic acid), poly(styrene-butadiene-methacrylic acid), poly(styrene-butadiene-acrylonitrile-acrylic acid), poly(styrene-butylacrylate-acrylic acid), poly(styrene-butylacrylate-methacrylic acid), poly(styrene-butylacrylate-acrylonitrile), poly(styrene-butylacrylate-acrylonitrile-acrylic acid), poly (styrene-butylacrylate-beta carboxy ethyl acrylate), and the like, as well as mixtures thereof. The polymers can be block, random, or alternating copolymers, as well as combinations thereof. In a specific embodiment, the polymer is a styrene/n-butylacrylate/β-carboxyethylacrylate copolymer wherein the molar ratio of monomers is from about 69 to about 90 parts styrene, from about 9 to about 30 parts n-butylacrylate, and from about 1 to about 10 parts β-carboxyethylacrylate, wherein the Mw value is from about 30,000 to about 40,000, and wherein the Mn value is from about 8,000 to about 15,000.

In specific embodiments, the resin can have a weight average molecular weight (Mw) of in one embodiment at least about 15,000, in another embodiment at least about 20,000, and in yet another embodiment at least about 25,000, and in one embodiment no more than about 55,000, in another embodiment no more than about 40,000, and in yet another embodiment no more than about 35,000.

In specific embodiments, the resin can have a number average molecular weight (Mn) of in one embodiment at least about 4,000, in another embodiment at least about 6,000, and in yet another embodiment at least about 8,000, and in one embodiment no more than about 20,000, in another embodiment no more than about 15,000, and in yet another embodiment no more than about 10,000.

In specific embodiments, the resin can have an onset glass transition temperature (Tg) of in one embodiment at least about 49° C., in another embodiment at least about 52° C., and in yet another embodiment at least about 53° C., and in one embodiment no more than about 55° C., in another embodiment no more than about 57° C., and in yet another embodiment no more than about 61° C.

Preparation of Resin

The emulsion polymer (to prepare emulsion aggregation particles) can be prepared by any desired or effective method. While the latex polymer can be prepared by any method within the purview of those skilled in the art, the latex polymer can, for example, be prepared by emulsion polymerization methods, such as semi-continuous emulsion polymerization. The latex can then be used to prepare a toner by, for example, emulsion aggregation methods. Emulsion aggregation entails aggregation of the latex polymer into larger size particles. Toners can be prepared by emulsion aggregation where a colorant is included with the latex polymer to be subjected to aggregation.

Any monomer suitable for preparing a latex for use in a toner can be used. As noted above, the toner can be produced by, for example, emulsion aggregation (EA). Suitable monomers useful in forming a latex polymer emulsion, and thus the resulting latex particles in the latex emulsion, include, for example, styrenes, acrylates, methacrylates, butadienes, isoprenes, acrylic acids, methacrylic acids, acrylonitriles, combinations thereof, and the like. The latex polymer can include a single polymer or can be a mixture of polymers. Polymers include, for example, styrene acrylates, styrene butadienes, styrene methacrylates, and more specifically, poly(styrene-alkyl acrylate), poly(styrene-1,3-diene), poly (styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butylacrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butylacrylate-isoprene), poly(styrene-propyl acrylate), poly (styrene-butylacrylate), poly (styrene-butadiene-acrylic acid), poly(styrene-butadiene-methacrylic acid), poly (styrene-butadiene-acrylonitrile-acrylic acid), poly(styrene-butylacrylate-acrylic acid), poly(styrene-butylacrylate-methacrylic acid), poly(styrene-butylacrylate-acrylononitrile), poly(styrene-butylacrylate-acrylonitrile-acrylic acid), poly (styrene-butadiene), poly(styrene-isoprene), poly(styrene-butyl methacrylate), poly(styrene-butylacrylate-acrylic acid), poly(styrene-butyl methacrylate-acrylic acid), poly (butyl methacrylate-butylacrylate), poly(butyl methacrylate-acrylic acid), poly(acrylonitrile-butylacrylate-acrylic acid), and combinations thereof. The polymers can be block, random, or alternating copolymers.

Toner Particle

Toners can be prepared by emulsion-aggregation processes that include aggregating a mixture of a latex, an optional colorant, an optional wax, any other desired or required additives, and emulsions including the selected resins described above, optionally in surfactants, and then coalescing the aggregate mixture at the temperature above the Tg of the aggregate resin.

Surfactants

Examples of nonionic surfactants include polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™ IGEPAL CA-520™, IGEPAL CA-720™, IGEPAL CO-890™, IGEPAL CO-720™, IGEPAL CO-290™, IGEPAL CA-210™, ANTAROX 890™, and ANTAROX 897™. Other examples of suitable nonionic surfactants include a block copolymer of polyethylene oxide and polypropylene oxide, including those commercially available as SYNPERONIC PE/F, such as SYNPERONIC PE/F 108.

Anionic surfactants include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ available from Daiichi Kogyo Seiyaku, combinations thereof, and the like. Other suitable anionic surfactants include DOWFAX™ 2A1, an alkyldiphenyloxide disulfonate from Dow Chemical Company, and/or TAYCA POWER BN2060 from Tayca Corporation (Japan), which are branched sodium dodecyl benzene sulfonates. Combinations of these surfactants and any of the foregoing anionic surfactants can be used.

Examples of cationic surfactants, which are usually positively charged, include alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, as well as mixtures thereof.

Wax

Optionally, a wax can also be combined with the resin and other toner components in forming toners. When included, the wax can be present in the toner formulatiion any desired or effective amount, in one embodiment at least about 1%, and in another embodiment at least about 5%, and in one embodiment no more than about 25%, and in another embodiment no more than about 20% by weight. Examples of suitable waxes include those having, for example, a weight average molecular weight of in one embodiment at least about 500, and in another embodiment at least about 1,000, and in one embodiment no more than about 20,000, and in another embodiment no more than about 10,000. Examples of suitable waxes include polyolefins, such as polyethylene, polypropylene, and polybutene waxes, including those commercially available from Allied Chemical and Petrolite Corporation, for example POLYWAX™ polyethylene waxes from Baker Petrolite, wax emulsions available from Michaelman, Inc. and Daniels Products Company, EPOLENE N-15™ commercially available from Eastman Chemical Products, Inc., and VISCOL 550-P™, a low weight average molecular weight polypropylene available from Sanyo Kasei K. K., and the like; plant-based waxes, such as carnauba wax, rice wax, candelilla wax, sumacs wax, jojoba oil, and the like; animal-based waxes, such as beeswax and the like; mineral-based waxes and petroleum-based waxes, such as montan wax, ozokerite, ceresin, paraffin wax, microcrystalline wax, Fischer-Tropsch wax such as the Q-436 wax (available from Cytech in Elizabethtown, Ky.), and the like; paraffin waxes such as the N-539 (available from Cytech in Elizabethtown, Ky.); ester waxes obtained from higher fatty acids and higher alcohols, such as stearyl stearate, behenyl behenate, and the like; ester waxes obtained from higher fatty acid and monovalent or multivalent lower alcohols, such as butyl stearate, propyl oleate, glyceride monostearate, glyceride distearate, pentaerythritol tetrabehenate, and the like; ester waxes obtained from higher fatty acids and multivalent alcohol multimers, such as diethyleneglycol monostearate, dipropyleneglycol distearate, diglyceryl distearate, triglyceryl tetrastearate, and the like; sorbitan higher fatty acid ester waxes, such as sorbitan monostearate and the like; and cholesterol higher fatty acid ester waxes, such as cholesteryl stearate and the like; and the like, as well as mixtures thereof. Examples of suitable functionalized waxes include amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated amide waxes, for example MICROSPERSION 19™ available from Micro Powder Inc., imides, esters, quaternary amines, carboxylic acids or acrylic polymer emulsions, for example JONCRYL 74™, 89™, 130™, 537™, and 538™, all available from SC Johnson Wax, chlorinated polypropylenes and polyethylenes available from Allied Chemical and Petrolite Corporation and SC Johnson Wax, and the like, as well as mixtures thereof. Mixtures and combinations of the foregoing waxes can also be used. Waxes can be included as, for example, fuser roll release agents. When included, the wax can be present in the toner formulation in any desired or effective amount, in one embodiment at least about 1%, and in another embodiment at least about 5%, and in one embodiment no more than about 25%, and in another embodiment no more than about 20% by weight.

In one specific embodiment, the formulation contains a Fischer Tropsch wax in an amount of in one embodiment at least about 7% by weight, in another embodiment at least about 8% by weight, and in yet another embodiment at least about 8.5% by weight, and in one embodiment no more than about 9% by weight, in another embodiment no more than about 10% by weight, and in yet another embodiment no more than about 11% by weight.

In one specific embodiment, the formulation contains a Paraffin wax in an amount of in one embodiment at least about 1.5% by weight, in another embodiment at least about 1.8% by weight, and in yet another embodiment at least about 2% by weight, and in one embodiment no more than about 2.4% by weight, in another embodiment no more than about 2.7% by weight, and in yet another embodiment no more than about 3% by weight.

In specific embodiments, the wax has a melting point of in one embodiment no more than about 100° C., in another embodiment no more than about 90° C., and in yet another embodiment no more than about 85° C.

Colorants

Examples of suitable colorants include pigments, dyes, mixtures thereof, and the like. Specific examples include carbon black such as Regal 330 from Cabot; magnetite; HELIOGEN BLUE L6900, D6840, D7080, D7020, PYLAM OIL BLUE, PYLAM OIL YELLOW, and PIGMENT BLUE 1, available from Paul Uhlich and Company, Inc.; PIGMENT VIOLET 1, PIGMENT RED 48, LEMON CHROME YELLOW DCC 1026, E.D. TOLUIDINE RED, and BON RED C, available from Dominion Color Corporation, Ltd., Toronto, Ontario; NOVAPERM YELLOW FGL and HOSTAPERM PINK E, available from Hoechst; CINQUASIA MAGENTA, available from E.I. DuPont de Nemours and Company; 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido) phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33,2,5-dimethoxy-4-sulfonanilide phenylazo-4'-chloro-2,5-dimethoxy acetoacetanilide, Yellow 180, Permanent Yellow FGL; Neopen Yellow 075, Neopen Yellow 159, Neopen Orange 252, Neopen Red 336, Neopen Red 335, Neopen Red 366, Neopen Blue 808, Neopen Black X53, Neopen Black X55; Pigment Blue 15:3 having a Color Index Constitution Number of 74160, Magenta Pigment Red 81:3 having a Color Index Constitution Number of 45160:3, Yellow 17 having a Color Index Constitution Number of 21105; Pigment Red 122 (2,9-dimethylquinacridone), Pigment Red 185, Pigment Red 192, Pigment Red 202, Pigment Red 206, Pigment Red 235, Pigment Red 269, combinations thereof, and the like.

The colorant is present in the toner formulation in any desired or effective total amount, in one embodiment at least about 1%, and in another embodiment at least about 5%, and in one embodiment no more than about 15%, and in another embodiment no more than about 10%.

Toner Preparation if desired, the mixture can be homogenized. If the mixture is homogenized, homogenization can be performed by mixing at from about 600 to about 4,000 revolutions per minute (rpm). Homogenization can be performed by any desired or effective method, for example, with an IKA ULTRA TURRAX T50 probe homogenizer.

Following preparation of the above mixture, an aggregating agent can be added to the mixture. Any desired or effective aggregating agent can be used to form a toner. Suitable aggregating agents include aqueous solutions of divalent cations or a multivalent cations. Specific examples of aggregating agents include polyaluminum halides such as polyaluminum chloride (PAC), or the corresponding bromide, fluoride, or iodide, polyaluminum silicates, such as polyaluminum sulfosilicate (PASS), and water soluble metal salts, including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and the like, as well as mixtures thereof. In specific embodiments, the aggregating agent can be added to the mixture at a temperature below the Tg of the resin.

The aggregating agent can be added to the mixture used to form a toner in any desired or effective amount, in one embodiment at least about 0.1%, in another embodiment at least about 0.2%, and in yet another embodiment at least about 0.5%, and in one embodiment no more than about 8%, and in another embodiment no more than about 5% by weight of the resin, wax, and pigment in the mixture.

The particles can be permitted to aggregate until a predetermined desired particle size is obtained. A particle composition comprising the initial predetermined desired particles is obtained before the addition of additional latex particles to form a shell structure. A predetermined desired size refers to the desired particle size to be obtained as determined prior to formation, with the particle size being monitored during the growth process until this particle size is reached. Samples can be taken during the growth process and analyzed, for example with a Coulter Counter, for average particle size. Once the predetermined desired particle size is reached, then the latex for the formation of the shell structure is added. The amount of added latex is based on the pre-defined particle formulation. In embodiments, the predetermined desired particle size is within the desired size of the final toner particles, such as, for example, within about 15% of the desired diameter of the final toner particles, within about 2% of the desired diameter of the final toner particles, or within about 0.5% of the desired diameter of the final toner particles.

Shell Formation

A shell can then be applied to the formed aggregated particles. Any resin described above as suitable for the core resin can be used as the shell resin. The shell resin can be applied to the aggregated particles by any desired or effective method. For example, the shell resin can be in an emulsion, including a surfactant. The aggregated particles described above can be combined with said shell resin emulsion so that the shell resin forms a shell over the formed aggregates. Suitable methods and resins for forming the core and shell structure are described in, for example, U.S. Patent Application Publication No. 2012/0258398, the disclosure of which is totally incorporated herein by reference. The shell resin may or may not have the same weight average molecular weight, number average molecular weight, and onset Tg of the resin used to make the core particle.

In one specific embodiment, the shell comprises the same resin or resins that are found in the core.

In one specific embodiment, the particles have a shell and the cores of the particles comprise a resin having a Tg lower than the Tg of the shells. In specific embodiments, the core has a Tg of in one embodiment at least about 40° C., in another embodiment at least about 45° C., and in yet another embodiment at least about 48° C., and in one embodiment no more than 59° C., in another embodiment no more than about 55° C., and in yet another embodiment no more than about 53° C. In specific embodiments, the shell has a Tg of in one embodiment at least about 55° C., in another embodiment at least about 58° C., and in yet another embodiment at least about 59° C., and in one embodiment no more than 65° C., in another embodiment no more than about 63° C., and in yet another embodiment no more than about 61° C.

Freezing Aggregation

Once the desired size of the particles to be acted on is achieved, the pH of the mixture can be adjusted with a base to a value of in one embodiment at least about 3, in another embodiment at least about 4, in yet another embodiment at least about 4.45, and in still another embodiment at least about 5, and in one embodiment no more than about 10, in another embodiment no more than about 9, in yet another embodiment no more than about 6, and in still another embodiment no more than about 5.5. The adjustment of the pH can be used to freeze, that is to stop, particle growth. The base used to stop particle growth can include any suitable base, such as alkali metal hydroxides including sodium hydroxide, potassium hydroxide, ammonium hydroxide, combinations thereof, or the like. In some embodiments, ethylene diamine tetraacetic acid (EDTA) can be added to help adjust the pH to the desired values noted above as well as chelate the metal ions present in the aggregation agent.

Before the slurry is heated to a coalescence temperature, the temperature of the slurry can reach a predetermined pH adjustment temperature and the pH of the slurry can be reduced to a predetermined coalescence pH by adding an aqueous acid solution, such as $HNO_3$. Adjusting the pH to a predetermined coalescence pH can increase spheroidization and preserve particle size distribution by controlling circularity based on pH at high temperatures. Examples of these processes include those disclosed in US 20110318685, the disclosure of which is totally incorporated herein by reference.

Coalescence

Coalescence is then carried out by continuously passing a frozen and/or aggregated toner slurry through at least one heat exchanger, where the heat exchanger(s) has been heated to a temperature suitable for coalescence, in one embodiment at least about 100° C., in another embodiment at least about 110° C., and in yet another embodiment at least about 120° C., and in one embodiment no more than about 150° C., in another embodiment no more than about 145° C., and in yet another embodiment no more than about 140° C.

Because the heat exchanger(s) may be heated to a temperature greater than the boiling point of water at atmospheric pressure, the system may be pressurized to a pressure sufficient (at the temperature selected for the heat exchanger) to avoid boiling the water component of the toner slurry. Atmospheric pressure refers, for example, to a pressure of about 760 torr, or 1 atmosphere (atm). The term "pressurized" refers, for example, to a pressure of the heat exchanger system that is greater than atmospheric pressure, such as a pressure greater than about 1 atm, or greater than about 1.5 atm, or greater than about 2 atm.

The pressure may be maintained at any desired pressure, such as a pressure greater than the vapor pressure of water. In contrast to a coalescence step of a typical batch process, where the temperature is kept below the boiling point of water at atmospheric pressure (such as less than about 96° C.) to avoid evaporating the water component of the toner slurry and boiling off the water present in the batch reactor, the system disclosed herein may be pressurized, and thus the temperature may be increased to temperatures above the atmospheric boiling point of water with minimal or no loss of water from boiling of the water component of the toner slurry. Thus, in the disclosed continuous process, the coalescence process to achieve the final toner-particle shape and morphology can be carried out at higher temperatures than typical batch processes.

As a result of these higher temperatures, the rate of spheroidization (coalescence) may be increased such that coalescence can be completed within a residence time on the order of minutes, in one embodiment at least about 1 second (sec), in another embodiment at least about 10 sec, and in yet another embodiment at least about 15 sec, and one embodiment no more than about 15 min, in another embodiment no more than about 10 min, and in yet another embodiment no more than about 5 min. As used herein, "residence time at temperature" refers to the time the toner slurry spends at a target temperature, such as a temperature suitable for coalescence, after the toner slurry has been heated to the target temperature within a heat exchanger. The residence time at temperature may be different from the time the toner slurry spends within the heat exchanger. For example, the toner slurry may be heated to temperature within a heat exchanger, and then coalescence may be completed by flowing the slurry through an insulated length of tubing such that the temperature drop is minimized. In some embodiments, the toner slurry may reach temperature at the outlet of the heat exchanger. In some embodiments, the toner slurry may reach temperature within the body of the heat exchanger.

Because the target spheroidization may be met by passing the frozen and/or aggregated toner slurry through the heat exchanger(s) with a residence time on the order of minutes, the throughput of the system may be dependent only on the size and temperature of the heat exchangers in the system. In contrast, batch processes are much longer, typically requiring hours (sometimes more than 10 hours) for the particles to reach the target spheroidization.

The frozen and/or aggregated toner slurry can be preheated, such as to a temperature greater than the Tg of the resin, before the toner slurry is heated to coalescence temperature in the heat exchanger(s). The temperature of the preheating may be greater than the Tg of the resin, but less than the coalescence temperature. For example, the temperature of the preheating may be at a temperature greater than the Tg of the resin of in one embodiment at least about 5° C., in another embodiment at least about 7.5° C., and in yet another embodiment at least about 10° C., and in one embodiment no more than about 30° C., in another embodiment no more than about 25° C., and in yet another embodiment no more than about 20° C. For example, the toner slurry may be preheated to about 65° C.

The frozen and/or aggregated toner slurry can be preheated to a temperature greater than the Tg of the resin before the toner slurry is added to the heat exchanger system. For example, the toner slurry can be preheated to a temperature greater than the Tg of the resin as a batch process in the aggregation vessel, or in a second vessel, before introducing the toner slurry to the heat exchanger system to continuously coalesce the particles. Pre-heating the slurry in the aggregation vessel prior to adding the slurry to the heat exchanger system eliminates the need for an additional piece of reaction equipment to carry out the preheating step.

By heating the toner slurry to a temperature greater than the Tg of the resin before introducing the toner slurry to the heat exchanger system, the continuous coalescence process does not produce any fines, which prevents a change in the geometric size distribution (GSD) of the toner. The term "fines" refers to toner particles having less than about 3 μm volume median diameter. Without being limited to a particular theory, it is believed that by heating the slurry beyond the Tg of the resin, the weakly aggregated particles may fuse together, making them more robust against temperature shock from the rate of heating in the heat exchanger. Thus, when the slurry is heated to a temperature greater than the Tg of the resin in a batch process before the slurry is introduced into the heat exchanger system to coalesce the particles continuously, the system produces zero fines.

The preheated toner slurry may be introduced to the heat exchanger system immediately after it is heated to a temperature greater than the Tg of the resin, or it may be cooled and/or stored before being introduced into the heat exchanger system. Once the toner slurry has been preheated, it may be added to the heat exchanger system at a temperature greater or less than the Tg of the resin. If the frozen and aggregated toner slurry has once been preheated to a temperature greater than the Tg of the resin, the toner slurry may be introduced to the heat exchanger system at a temperature less than the Tg of the resin without the generation of fines; a toner slurry that has been cooled need not be reheated before being introduced into the heat exchanger system to avoid the generation of fines.

The toner slurry may be preheated, such as to a temperature greater than the Tg of the resin, after being introduced to the heat exchanger system. The frozen and/or aggregated toner slurry may be preheated by passing the toner slurry through at least one heat exchanger heated to a temperature greater than the Tg of the resin but less than the coalescence temperature. For example, the toner slurry may be passed through a heat exchanger system comprising at least two heat exchangers, where the first heat exchanger and the second heat exchanger are heated to different temperatures.

The first heat exchanger can be heated to a temperature greater than the Tg of the resin, but less than the coalescence temperature, to preheat the toner slurry to a temperature greater than the Tg of the resin. For example, the first heat exchanger can be heated to a temperature of in one embodiment at least about (Tg+5° C.), in another embodiment at least about (Tg+7.5° C.), and in yet another embodiment at least about (Tg+10° C.), and in one embodiment no more than about (Tg+30° C.), in another embodiment no more than about (Tg+25° C.), and in yet another embodiment no more than about (Tg+20° C.). In one specific example, the first heat exchanger can be heated to a temperature of in one embodiment at least about 60° C., in another embodiment at least about 63° C., and in yet another embodiment at least about 65° C., and in one embodiment no more than about 110° C., in another embodiment no more than about 100° C., and in yet another embodiment no more than about 75° C. The second heat exchanger can be heated to a temperature suitable for coalescence. For example, the second heat exchanger can be heated to a temperature of in one embodiment at least about 100° C., in another embodiment at least about 110° C., and in yet another embodiment at least about 120° C., and in one embodiment no more than about 150° C., in another embodiment no more than about 145° C., and in yet another embodiment no more than about 140° C. The first heat exchanger preheats the toner slurry to a temperature greater than the Tg of the resin, which prevents the large generation of fines.

The step of preheating the toner slurry can serve to decrease temperature shock on the slurry when it passes through the second (higher temperature) heat exchanger. Preheating in the first heat exchanger may also allow for some partial coalescence in the first heat exchanger. Tthis partial coalescence in the first heat exchanger may represent in one embodiment at least about 2%, and in another embodiment at least about 5%, and in one embodiment no more than about 20%, and in another embodiment no more than about 15%, of the coalescence process. For example, the partial coalescence in the first heat exchanger may result in the particles that may have a mean circularity of in one embodiment at least about 0.88, in another embodiment at least about 0.89, and in yet another embodiment at least about 0.90, and in one embodiment no more than about 0.94, and in another embodiment no more than about 0.93. Such particles can then be processed further in subsequent heat exchangers to obtain particles having a mean circularity of in one embodiment at least about 0.930, in another embodiment at least about 0.940, and in yet another embodiment at least about 0.945, and in one embodiment no more than about 0.990, in another embodiment no more than about 0.985, and in yet another embodiment no more than about 0.980. This initial fusing may yield more robust particles after the particles pass through the higher-temperature heat exchanger, thereby preventing the large generation of fines.

In other embodiments, the toner slurry can pass through at least two heat exchangers, wherein a first heat exchanger is at a higher temperature than a second heat exchanger. For example, the first heat exchanger can be heated to a temperature of from about 100° C. to about 150° C., such as from about 110° C. to about 145° C., or from about 120° C. to about 140° C. The second heat exchanger may be at a lower temperature than the first heat exchanger, such that the second heat exchanger quenches the temperature of the toner slurry after it exits the higher temperature heat exchanger. In embodiments, the second heat exchanger may reduce the temperature of the toner slurry to a temperature suitable for pH adjustment. For example, the second heat exchanger may reduce the temperature of the toner slurry in a range of from about 40° C. to about 90° C. below the coalescence temperature, such as from about 45° C. to about 80° C. lower than the coalescence temperature, or from about 50° C. to about 70° C. lower than the coalescence temperature. In embodiments, the temperature may be quenched to a temperature suitable for discharge, which in embodiments may be a temperature lower than the Tg of the toner.

The toner slurry can also be passed through more than one heat exchanger maintained at the same temperature. For example, two or more heat exchangers may be connected in series and heated to the same temperature on the shell side of the heat exchangers, such as with the same heating utility, such that the two or more heat exchangers function as a single, longer heat exchanger.

In a heat exchanger system comprising at least one heat exchanger, the residence time within any single heat exchanger can be any desired or effective period of time, in one embodiment at least about about 0.1 min, in another embodiment at least about 1 min, and in yet another embodiment at least about 3 min, and in one embodiment no more than about 30 min, in another embodiment no more than about 15 min, and in yet another embodiment no more than about 10 min. The total residence time of the toner slurry in a heat exchanger system comprising at least one heat exchanger is the sum of the residence times of the individual heat exchangers in the system. Thus, the total residence time of the toner slurry in the heat exchanger system depends on the number of heat exchangers in the system, and the temperature of each heat exchanger.

Residence time can also be expressed or calculated in terms of flow rate. The flow rate of the toner slurry through the system and the volume of the heat exchanger(s) are related to the residence time as follows:

$$\text{flow rate expressed in liters per minute: } \frac{L_1}{m_1}$$

$$\text{volume of heat exchanger expressed in liters: } L_2$$

$$\text{time needed for toner slurry to go through heat exchanger: } m_2$$

$$\frac{m_1}{L_1} \times L_2 = m_2$$

An exemplary embodiment of the process used herein is shown in FIG. 1, which illustrates how four heat exchangers may be connected to ramp, coalesce, and cool particles. In FIG. 1, first heat exchanger 10, second heat exchanger 20, third heat exchanger 30, and fourth heat exchanger 40, are used to ramp a frozen and aggregated toner slurry to a coalescence temperature, coalesce the particles, and then cool the particles. Pressure is maintained by a back pressure regulating device (not pictured). The device can be located anywhere within the system so long as the temperature of the slurry is below 100° C. upon exiting the pressure regulating device. It may optionally be situated between second heat exchanger 20 and third heat exchanger 30, before optionally at least one static mixer (not pictured), also located between second heat exchanger 20 and third heat exchanger 30, or optionally located at the outlet of the system.

In one embodiment suitable for the configuration illustrated in FIG. 1, first heat exchanger 10 is heated to from about 100° C. to about 115° C. using a warm bath flowed along path P-6, over heat exchanger 10, to path P-7. Second heat exchanger 20 is heated to from about 115° C. to about 150° C. by a heated bath flowed from path P-8, over heat exchanger 20, to path P-9 so that the particles can reach a desired coalescence temperature.

In other embodiments, first heat exchanger 10 can be heated to a temperature greater than the Tg of the resin and second heat exchanger 20 can be heated to a temperature suitable for coalescence.

A cool bath, such as a domestic chilled water bath, can be used to maintain third heat exchanger 30 at a temperature lower than second heat exchanger 20, such as from about 40° C. to about 90° C., by flowing the cool bath from path P-10, over heat exchanger 30, to path P-11. The particles can thus be cooled by passing through third heat exchanger 30 after passing through second heat exchanger 20, passing from path P-3 to path P-4 via heat exchanger 30. The particles may be cooled to a temperature suitable for pH adjustment. To adjust the pH, an aqueous base solution, such as NaOH, can be fed into the toner slurry, at a point such as after second heat exchanger 20 between the back pressure regulator and at least one static mixer. The static mixer or mixers can then mix the aqueous base solution into the slurry before the slurry enters fourth heat exchanger 40, where it can be cooled to a temperature suitable for discharge, such as a temperature lower than the Tg of the toner, before the toner slurry exits through path P-5. The temperature of heat exchanger 40 can be maintained by flowing a bath from path P-12, over heat exchanger 40, to path P-13.

Additionally, in specific embodiments, a system of heat exchangers can be connected such that energy can be recovered from the ramp and coalescence step, thereby yielding greater energy efficiency in the process. For example, the system can comprise at least three heat exchangers, wherein the first and third heat exchangers are connected in a closed loop, and the second heat exchanger is heated to a temperature suitable for coalescence. The first heat exchanger preheats the incoming toner slurry prior to the slurry passing through the second (higher temperature) heat exchanger, and the third heat exchanger cools the toner slurry after it passes through the second (higher temperature) heat exchanger. In this embodiment, the first heat exchanger increases the temperature of the toner slurry from its initial temperature to in one embodiment at least about 51° C., and in another embodiment at least about 60° C., and in one embodiment no more than about 95° C., in another embodiment no more than about 85° C., and in yet another embodiment no more than about 79° C. In this embodiment, the second heat exchanger is heated to a temperature of in one embodiment at least about 100° C., in another embodiment at least about 110° C., and in yet another embodiment at least about 120° C., and in one embodiment no more than about 150° C., in another embodiment no more than about 145° C., and in yet another embodiment no more than about 140° C. In this embodiment, the third heat exchanger, connected in a closed loop with the first heat exchanger, cools the toner slurry to a temperature of in one embodiment at least about 60° C., in another embodiment at least about 70° C., and in yet another embodiment at least about 75° C., and in one embodiment no more than about 100° C., in another embodiment no more than about 90° C., and in yet another embodiment no more than about 85° C., after the toner slurry exits the second heat exchanger. Where the first and third heat exchangers are connected in a closed loop, energy input into the system to heat the toner slurry can be recovered.

The process steps of the continuous process for coalescing particles can include heating at least one heat exchanger to a temperature suitable for coalescence, and passing the toner slurry, such as a frozen and aggregated toner slurry, through the heat exchanger(s) to coalesce the particles. In embodiments, the system is pressurized, such that an average pressure may be maintained, for example, at value greater than the vapor pressure of water. In such a pressurized system, the temperature may be increased to temperatures above the atmospheric boiling point of water without boiling the water component of the toner slurry. For example, the heat exchanger(s) can be heated to in one embodiment at least about 100° C., in another embodiment at least about 110° C., and in yet another embodiment at least about 120° C., and in one embodiment no more than about 150° C., in another embodiment no more than about 145° C., and in yet another embodiment no more than about 140° C. In these embodiments, the pressure of the heat exchanger(s) can be maintained at a predetermined temperature and pressure wherein the pressure is greater than the vapor pressure of water (at the predetermined temperature) by in one embodiment at least about 1%, in another embodiment at least about 5%, in another embodiment at least about 10%, and in yet another embodiment at least about 15%, and in one embodiment by no more than about 800%, in another embodiment no more than about 30%, in yet another embodiment no more than about 25%, and in yet another embodiment no more than about 10%. In one specific embodiment, for a given temperature, the pressure of one or more of the heat exchangers of the system and/or the entire system may be about 10% greater than the vapor pressure of water.

The temperature and pressure of the one or more of the heat exchangers of the system and/or the entire system can be set to prevent the water component of the toner slurry from boiling. For example, at elevated pressures above 1 atm, one or more of the heat exchangers of the system and/or the entire system can be heated to temperatures above the atmospheric boiling point of water (for example, above about 100° C., or in a range of from about 100° C. to about 200° C.). In specific embodiments, the pressure of the system can be maintained at a predetermined pressure by a back pressure regulator, a peristaltic pump, a gear pump, a progressive cavity pump, or the like. In specific embodiments, the system can maintain a predetermined pressure by discharging through a back-pressure regulating diaphragm valve, which allows for discharge to the atmosphere.

In the methods disclosed herein, the slurry can be ramped to a predetermined coalescence temperature, and the temperature of the slurry can be maintained at that temperature that allows the particles to coalesce. High temperatures can be used in one or more of the pressurized heat exchangers of the system to increase the rate of spheroidization such that coalescence can be completed within a residence time on the order of minutes.

Because the target spheroidization can be met by passing frozen and aggregated toner slurry through the heat exchanger(s) with a residence time on the order of minutes, throughput of the system is dependent only on the size and temperature of the heat exchanger. In embodiments, coalescence can take place entirely within the heat exchanger(s); the toner slurry is continuously added to the heat exchanger(s), and fully coalesced particles having a target degree of spheroidization can be recovered continuously from the heat exchanger(s). The coalesced particles can be measured periodically for circularity, such as with a SYSMEX FPIA 2100 analyzer or SYSMEX FPIA 3000 analyzer. As defined by the equipment manufacturer, the Circularity of the particle is the ratio of the circumference of the circle of equivalent area as the particle over the actual perimeter of the particle:

$$\text{Circularity} = \frac{\text{Circumference of circle of equivalent area of the particle}}{\text{Actual particle perimeter}}$$

A circularity of 1.000 indicates a completely circular sphere. Particles produced by the methods disclosed herein can have a mean circularity of in one embodiment at least about 0.930, in another embodiment at least about 0.940, and in yet another embodiment at least about 0.945, and in one embodiment no more than about 0.990, in another embodiment no more than about 0.985, and in yet another embodiment no more than about 0.980. The target mean circularity can be reached with a residence time at temperature of in one embodiment at least about 1 sec, in another embodiment at least about 10 sec, in yet another embodiment at least about 15 sec, and in yet another embodiment at least about 30 sec, and in one embodiment no more than about 15 min, in another embodiment no more than about 10 min, in yet another embodiment no more than about 5 min, and in still another embodiment no more than about 2 min.

In one specific embodiment, the heat exchanger(s) is a standard shell-tube heat exchanger. The shell-side of the heat exchanger may be exposed to a bath having a desired temperature to heat or cool the heat exchanger to the desired temperature. The bath can be an oil bath, such a glycol bath a glycol/water mixture bath, or the like.

A single heat exchanger can be used to conduct the coalescence step. Alternatively, the toner slurry can be passed through more than one heat exchanger during the ramp and coalescence process.

After coalescence, the mixture can be cooled to room temperature, such as from about 20° C. to about 25° C. The cooling may be rapid or slow, as desired. A suitable cooling method can include introducing cold water to a jacket around at least one additional heat exchanger to quench. After cooling, the particles can optionally be washed with water and then dried to form final toner particles. Drying can be carried out by any suitable method, such as freeze-drying or the like.

The cooling process can include an additional pH adjustment at a predetermined cooling pH temperature. For example, at least one additional heat exchanger can quench the temperature of the toner slurry from the coalescence temperature to a pH adjustment temperature. The predetermined cooling pH adjustment temperature can be below the predetermined coalescence temperature by an amount of in one embodiment at least about 40° C., in another embodiment at least about 45° C., and in yet another embodiment at least about 50° C., and in one embodiment no more than about 90° C., in another embodiment no more than about 80° C., and in yet another embodiment no more than about 70° C. The pH of the slurry can be adjusted to a predetermined cooling pH of in one embodiment at least about 7.0, in another embodiment at least about 7.5, in yet another embodiment at least about 8.0, and in still another embodiment at least about 8.7, and in one embodiment no more than about 10, in another embodiment no more than about 9.5, in yet another embodiment no more than about 9.0, and in still another embodiment no more than about 8.9. This pH adjustment can be done by adding an aqueous base solution, such as NaOH. The temperature of the slurry can be maintained at the predetermined cooling pH adjustment temperature for any effective or desired time period, in one embodiment about 1 min, and in another embodiment at least about 5 min, and in one embodiment no more than about 60 min, and in another embodiment no more than about 30 min, followed by cooling to room temperature. The system can further contain at least one additional heat exchanger to quench the temperature of the toner slurry further from the pH adjustment temperature to a temperature suitable for discharge, such as room temperature.

Figure 2:
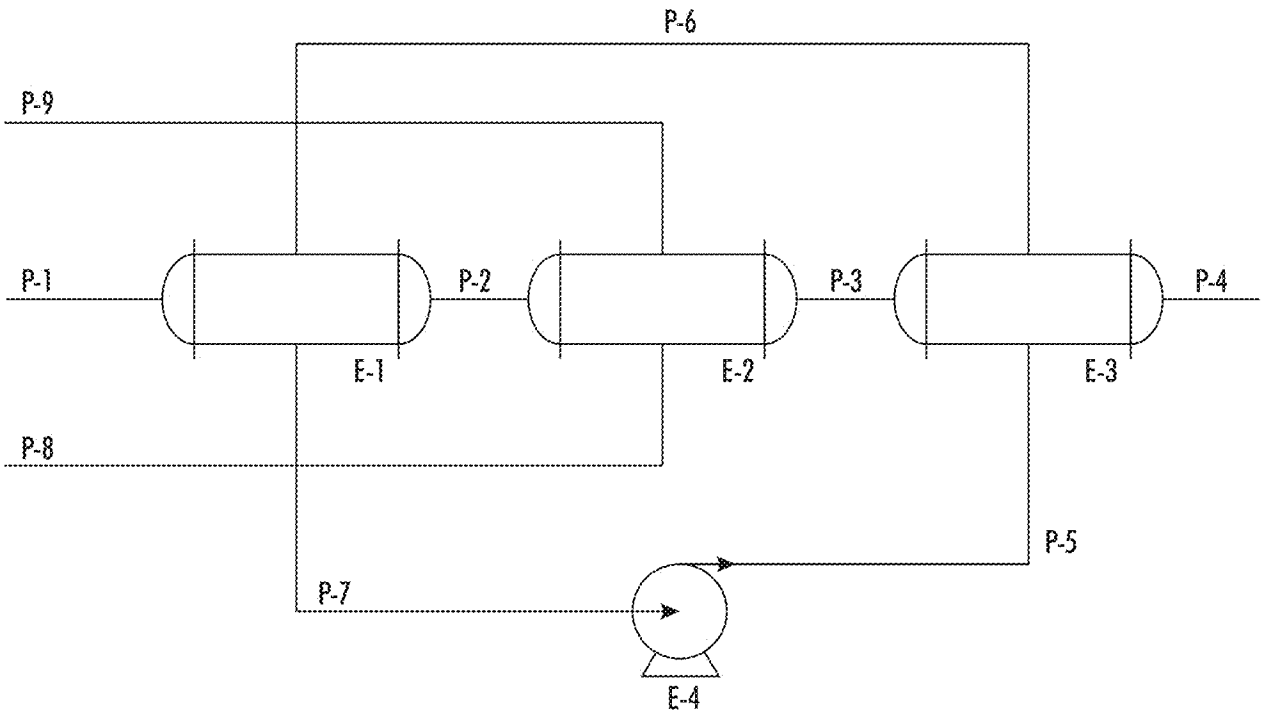
FIG. 2 illustrates a system for carrying out ramp/coalescence in an emulsion aggregation process incorporating three heat exchangers, in which the first and third heat exchangers are connected in a closed loop to recover energy from the process.

FIG. 2 illustrates how three heat exchangers can be connected for energy recovery high temperature coalescence. In FIG. 2, three heat exchangers E-1, E-2, and E-3 are used to ramp a frozen and aggregated toner slurry to a coalescence temperature, coalesce the particles, and then cool the slurry. Second heat exchanger E-2 is heated to a desired coalescence temperature by a bath flowed from path P-8 to path P-9, while first heat exchanger E-1 and third heat exchanger E-3 are connected in a closed loop by a bath flowed around heat exchanger E-3 along path P-5 to path P-6 and then around heat exchanger E-1 by passing from path P-6 to path P-7, by pump E-4 to recover heat energy from the process to reduce energy requirements in preheating the incoming slurry. For example, a bath can be heated and passed on the shell-side of second heat exchanger E-2, while a bath can be passed on the shell-sides of the first and second heat exchangers E-1 and E-3 in a closed loop.

Because the first and third heat exchangers are connected in a closed loop, the system is able to recover a significant amount of energy which has been inputted into the system to heat the slurry to a temperature above, for example, about 120° C. The total energy input and peak energy demand are therefore greatly reduced. For example, in FIG. 2, if first heat exchanger E-1 ramped the incoming slurry from about 51° C. to temperatures above about 79° C., second heat exchanger E-2 heated the slurry from above about 79° C. to above about 120° C., and third heat exchanger E-3 cooled the slurry from temperatures above about 120° C. to temperatures about 80° C., because the entrance temperature of the toner slurry is about 51° C. and the exit temperature is about 80° C., the net increase in temperature is only about 29° C. In contrast, in batch processes, it is very difficult to recover energy from the ramping of toner slurry to coalescence temperatures because of the limitation of how efficiently energy can be stored over time scales associated with batch-batch cycles.

In producing toner particles, it is desirable to control the toner particle size and limit the amount of both fine and coarse toner particles in the toner. In some embodiments, the toner particles have a very narrow particle size distribution with a lower geometric standard deviation (GSDn) by number of approximately 1.15 to approximately 1.30, such as approximately less than about 1.25. The toner particles also may have a size such that the upper geometric standard deviation (GSDv) by volume is in the range of from about 1.15 to about 1.30, such as from about 1.18 to about 1.22, or less than about 1.25.

The characteristics of the toner particles can be determined by any suitable technique and apparatus. Volume average particle diameter D50v, GSDv, and GSDn can be measured by means of a BECKMAN COULTER MULTISIZER 3 with a 50 micron aperture orifice and operated in accordance with the manufacturer's instructions. The GSDv refers to the upper geometric standard deviation (GSDv) by volume (coarse level) for (D84/D50). The GSDn refers to the geometric standard deviation (GSDn) by number (fines level) for (D50/D16). The particle diameters at which a cumulative percentage of 50% of the total toner particles are attained is defined as volume D50, and the particle diameters at which a cumulative percentage of 84% are attained are defined as volume D84. The volume average particle size distribution index GSDv can be expressed by using D50 and D84 in cumulative distribution, wherein the volume average particle size distribution index GSDv is expressed as (volume D84/volume D50). The number average particle size distribution index GSDn can be expressed by using D50 and D16 in cumulative distribution, wherein the number average particle size distribution index GSDn is expressed as (number D50/number D16). The closer to 1.0 the GSD value is, the less size dispersion there is among the particles.

While not desiring to be limited to any particular theory, it is believed that toner particles prepared by the continuous processes disclosed herein result in larger and more spherical wax domains within the particles compared to the longer and more platelet-shaped domains found in toner particles prepared by previously taught batch emulsion aggregation processes.

The size and shape of the wax domains within a toner particle can be assessed via Transmission Electron Microscopy (TEM). The toner particles are mounted on an epoxy substrate and sliced with a Diatome ultrasonic knife to enable visual observation of the cross section of the particles. The visual assessment is performed from micrographs taken by a Hitachi Transmission Electron Microscope. Wax domains in the toner particles prepared by the processes disclosed herein have an aspect ratio of in one embodiment at least about 1.4, in another embodiment at least about 1.5, and in yet another embodiment at least about 1.6, and in one embodiment no more than about 1.8, in another embodiment no more than about 1.7, and in yet another embodiment no more than about 1.6. The aspect ratio is defined as the ratio of the length of the wax domain to its width when the length is larger than the width and it is determined from micrographs taken by a Hitachi Transmission Electron Microscope Optional Additives The toner particles can also contain other optional additives as desired. For example, the toner can include positive or negative charge control agents in any desired or effective amount, in one embodiment in an amount of at least about 0.1 percent by weight of the toner, and in another embodiment at least about 1 percent by weight of the toner, and in one embodiment no more than about 10 percent by weight of the toner, and in another embodiment no more than about 3 percent by weight of the toner, although amounts outside of these ranges can be used. Examples of suitable charge control agents include, but are not limited to, quaternary ammonium compounds inclusive of alkyl pyridinium halides; bisulfates; alkyl pyridinium compounds, including those disclosed in U.S. Pat. No. 4,298,672, the disclosure of which is totally incorporated herein by reference; organic sulfate and sulfonate compositions, including those disclosed in U.S. Pat. No. 4,338,390, the disclosure of which is totally incorporated herein by reference; cetyl pyridinium tetrafluoroborates; distearyl dimethyl ammonium methyl sulfate; aluminum salts such as BONTRON E84™ or E88™ (Hodogaya Chemical); and the like, as well as mixtures thereof. Such charge control agents can be applied simultaneously with the shell resin described above or after application of the shell resin.

The toner particle scan contain lubricant additives to increase the robustness of the cleaning subsystem. Lubricant additives can be included in any desired or effective amount, in one embodiment in a mount of at least about 0.1 percent by weight of the toner, and in another embodiment at least about 1 percent by weight of the toner, and in one embodiment no more than about 3 percent by weight of the toner, and in another embodiment no more than about 2 percent by weight of the toner, although amounts outside of these ranges can be used. An example of suitable lubricant additives includes, but is not limited to high molecular weight saturated aliphatic primary alcohols such as Unilin 700 by Baker Petrolite, There can also be blended with the toner particles external additive particles, including flow aid additives, which can be present on the surfaces of the toner particles. Examples of these additives include metal oxides, such as titanium oxide, silicon oxide, and the like, as well as mixtures thereof; colloidal and amorphous silicas, such as AEROSIL®, metal salts and metal salts of fatty acids including zinc stearate, aluminum oxides, cerium oxides, and the like, as well as mixtures thereof. Each of these external additives can be present in any desired or effective amount, in one embodiment at least about 0.1%, and in another embodiment at least about 0.25%, and in one embodiment no more than about 5%, and in another embodiment no more than about 3% by weight of the toner. Suitable additives include those disclosed in U.S. Pat. No. 3,590,000, U.S. Pat. No. 3,800,588, and U.S. Pat. No. 6,214,507, the disclosures of each of which are totally incorporated herein by reference. toner particles can exhibit improved gloss compared to toners of identical composition prepared by a batch process. Toners prepared by the process disclosed herein, when printed and fused onto plain paper, such as CXS 90 gsm, with an internally developed fixture equipped with a Xerox 700 Digital Color Press fuser wherein the fusing temperature was adjusted over a range of 125° C. to 210° C., the fusing speed was about 220 millimeters per second (mm/s), and the nip dwell time was about 34 milliseconds (ms), can exhibit gloss values, measured by a gloss meter by BYK-Gardner USA, for example, of in one embodiment at least about 33 ggu, in another embodiment at least about 35 ggu, and in yet another embodiment at least about 36 ggu, and in one embodiment no more than about 40 ggu, in another embodiment no more than about 38 ggu, and in yet another embodiment no more than about 37 ggu. These gloss values are specific to a fusing temperature of 190° C., which is the target under nominal operating conditions.

Toners prepared by the process disclosed herein were printed and fused using a modified DC12 copier. Impressions were generated with a toner mass per unit area target of 1.00 mg/cm$^2$ on CXS 90 gsm paper. The gloss and crease area targets were a square image placed in the center of the page.

The crease area of the toners prepared by the process disclosed herein, when printed and fused, was measured over a fuser temperature range of 125° C. to 160° C. The crease area of the impressions is measured by an in-house image analysis system consisting of a CCD camera, motorized stage and vision analysis software. Fused prints were folded, then unfolded and wiped along the creased fold with a cotton ball to remove the fracture toner. The creased prints were placed under the image analysis system and the amount the amount of toner that was removed from the sheet was determined. The temperature at which the crease area reaches a value of 80 was then calculated. The toners prepared by the process disclosed herein exhibit crease area values of in one embodiment at least about 130° C., in another embodiment at least about 133° C., and in yet another embodiment at least about 136° C., and in one embodiment no more than about 136° C., in another embodiment no more than about 137° C., and in yet another embodiment no more than about 135° C. The temperature at which the crease area reaches a value of 40 was also calculated. The toners prepared by the process disclosed herein exhibit crease area values of in one embodiment at least about 139° C., in another embodiment at least about 140° C., and in yet another embodiment at least about 142° C., and in one embodiment no more than about 143° C., in another embodiment no more than about 145° C., and in yet another embodiment no more than about 146° C. The Minimum Fix Temperature (MFT) of the toner particles can be determined from the temperatures at which the crease area is 80 units or 40 units. In the comparative examples these are referred to as MFT (80), which is measured at 80 crease units, and MFT (40), which is measured at 40 crease units. The Minimum Fix Temperature defines the minimum temperature at which the toner particles need to be fused in order for the fused image not to exceed a pre-defined crease area target. For example, toners prepared by the process disclosed herein, when printed and fused exhibit Minimum Fix Temperature for a crease area of 80 in one embodiment at least about 131° C., in another embodiment at least about 135° C., and in yet another embodiment at least about 136° C., and in one embodiment no more than about 136° C., in another embodiment no more than about 137° C., and in yet another embodiment no more than about 135° C.

The toner particles can be formulated into a developer composition. The toner particles can be mixed with carrier particles to achieve a two-component developer composition. The toner concentration in the developer can be of any desired or effective concentration, in one embodiment at least about 1%, and in another embodiment at least about 2%, and in one embodiment no more than about 25%, and in another embodiment no more than about 15% by weight of the total weight of the developer.

Specific embodiments will now be described in detail. These examples are intended to be illustrative, and the claims are not limited to the materials, conditions, or process parameters set forth in these embodiments. All parts and percentages are by weight unless otherwise indicated.

Comparative Example A

Batch Coalescence of an Aggregated Particle Slurry

An aggregated toner slurry was prepared by charging a 20 gallon reactor with 33.95 kg of de-ionized water, 14.9 kg of a styrene-butylacrylate resin in a latex emulsion having a solids content of about 41.5%, and 4.16 kg of a Cabot Regal R330 carbon black pigment dispersion having a solids content of about 17%. The contents in the reactor were then mixed together.

After mixing, 3.20 kg of Cytech Q-436 polymethylene wax dispersion having a solids content of about 31%, 0.80 kg of a Cytech N-539 paraffin wax dispersion having a solids content of about 31%, and 0.198 kg of an acid solution of polyaluminum chloride was added to the mixture. The wax dispersions were added through a homogenization loop to ensure that large agglomerates were broken down into smaller size particles. After the wax dispersion and the solution of polyaluminum chloride were added to the reactor, the components in the reactor were homogenized for forty-five minutes, or until the size distribution of the particles in the dispersion is such that the percentage on a volume basis between 5 and 12 microns is less than 2%. The particle size was determined using a Beckman Coulter Multisizer III.

After the ingredients in the reactor were homogenized, the temperature of the mixture was raised to about 51.5° C., until the particles aggregate and reach the target size of about 5.3 to 5.5 microns. The particle size was measured using a Beckman Coulter Multisizer III. At this point, the pre-shell aggregate or core formation has been completed.

Once the particles reached the target size discussed above, an additional 7.59 kg of a styrene-butylacrylate resin in a latex emulsion was added into the reactor. The latex was mixed into the reactor until the particles reached their final target size of about 6.4 to 7.0 microns, and at least 30 minutes have elapsed between the end of the shell addition and the time when the particles in dispersion reach the target size. It has been determined that 30 minutes is sufficient time to incorporate all of the additional latex emulsion onto the surface of the core particles. When this condition is achieved, the concentration of fine particles smaller than three microns stabilizes and reaches a plateau.

Once the target size was reached and the shell formation step was completed, the growth of the particles was stopped by adjusting the pH of the aggregated toner slurry to a range of about 3.95 to about 4.05 using a 1 molar solution of sodium hydroxide. In addition, at the same time as the pH adjustment, 0.085 kg ethylenediamine tetra acetate (EDTA) was added to the aggregated particles. After reaching a pH in the range of about 3.95 to about 4.05, the pH of the aggregated toner slurry was further adjusted to a pH in the range of about 5.3 to about 5.5 using a 1 molar solution of sodium hydroxide.

The aggregated slurry was then heated to 80° C. Once this temperature was reached, the pH of the aggregated slurry was measured to ensure that it was within a target pH range of about 5 to about 5.4. The particle slurry was then heated until it reached a temperature of 96° C. Once the temperature of 96° C. was reached, the temperature was held constant for three hours. During the three hours, the circularity of the particles was measured using a FPIA-Sysmex 3000. Within the three hour period of time, the pH of the slurry was adjusted to 6.5 to 7.1 by the addition of a 1 molar solution of sodium hydroxide. At the end of the three hour period, the temperature of the slurry temperature was lowered to 43° C. During the lowering of the temperature, when the temperature of the slurry reached 63° C., the pH of the slurry was adjusted to within the range of about 8.7 to about 8.9 by the addition of a 1 molar solution of sodium hydroxide.

The aggregated toner particles, including the shell, contain about 83% styrene-butylacrylate resin, 6% carbon black pigment, 8.8% polymethylene wax, and 2.2% paraffin wax. The carbon black pigment concentration was verified by performing Thermogravimetric Analysis (TGA) using a Q500 thermogravimetric analyzer from TA Instruments. The analysis is based on the weight loss of a sample over a wide range in temperature as the organic ingredients are decomposed due to the extreme temperatures. The wax concentration was verified by performing Differential Scanning calorimetry Analysis (DSC) using a Q100 differential scanning calorimeter from TA Instruments. This analysis is based on the rate of heat transfer required to maintain a sample at a specific temperature and how the rate of heat transfer changes when the sample or component within the sample undergoes a phase transition. By observing the changes in the heat transfer of the test sample and a reference, the instrument can measure the amount of heat absorbed or released by the sample during a phase transition. This information can then be used to determine the concentration of components within the sample that underwent a phase transition, for example, the concentration of the waxes in a toner sample.

Table 1 shows the fusing test results of two slurries that were coalesced in batch mode.

TABLE 1

Characterization of Aggregated Slurry Particles Coalesced in Batch Mode

| Slurry | Gloss at 190° C. | MFT (C80) | MFT (C40) | Cold Offset Temperature ° C. |
|---|---|---|---|---|
| 1 | 32 | 142 | 151 | 133 |
| 2 | 33 | 142 | 149 | 133 |

Comparative Example I

Continuous Coalescence of an Aggregated Particle Slurry

An aggregated toner slurry was prepared with the same lot of raw materials from Comparative Example A by charging a 20 gallon reactor with 33.95 kg of de-ionized water, 14.9 kg of a styrene-butylacrylate resin in a latex emulsion having a solids content of about 41.5%, and 4.16 kg of a Cabot Regal R330 carbon black pigment dispersion having a solids content of about 17%. The contents in the reactor were then mixed together.

After mixing, 3.20 kg of Cytech Q-436 polymethylene wax dispersion having a solids content of about 31%, 0.80 kg of a Cytech N-539 paraffin wax dispersion having a solids content of about 31%, and 0.198 kg of an acid solution of polyaluminum chloride was added to the mixture. The wax dispersions were added through a homogenization loop to ensure that large agglomerates were broken down into smaller size particles. After the wax dispersion and the solution of polyaluminum chloride were added to the reactor, the components in the reactor were homogenized for forty-five minutes, or until the size distribution of the particles in the dispersion is such that the percentage on a volume basis between 5 and 12 microns is less than 2%. The particle size was determined using a Beckman Coulter Multisizer III.

After the ingredients in the reactor were homogenized, the temperature of the mixture was raised to about 51.5° C., until the particles aggregate and reach the target size of about 5.3 to 5.5 microns. The particle size was measured using a Beckman Coulter Multisizer III. At this point, the pre-shell aggregate or core formation has been completed.

Once the particles reached the target size discussed above, an additional 7.59 kg of a styrene-butylacrylate resin in a latex emulsion was added into the reactor. The latex was mixed into the reactor until the particles reached their final target size of about 6.4 to 7.0 microns, and at least 30 minutes have elapsed between the end of the shell addition and the time when the particles in dispersion reach the target size. It has been determined that 30 minutes is sufficient time to incorporate all of the additional latex emulsion onto the surface of the core particles. When this condition is achieved, the concentration of fine particles smaller than three microns stabilizes and reaches a plateau.

Once the target size was reached and the shell formation step was completed, the growth of the particles was stopped by adjusting the pH of the aggregated toner slurry to a range of about 3.95 to about 4.05 using a 1 molar solution of sodium hydroxide. In addition, at the same time as the pH adjustment, 0.085 kg ethylenediamine tetra acetate (EDTA) was added to the aggregated particles. After reaching a pH in the range of about 3.95 to about 4.05, the pH of the aggregated toner slurry was further adjusted to a pH in the range of about 5.3 to about 5.5 using a 1 molar solution of sodium hydroxide. The particles were then preheated and ramped to 65° C. and held for 15 minutes before storage and transport for continuous coalescence.

The coalescence step was carried out by continuously passing the aggregated toner slurry through at least one heat exchanger, where the at least one heat exchanger has been heated to a temperature suitable for coalescence. For example, the at least one heat exchanger may be heated to a temperature of from about 100° C. to about 150° C., such as from about 110° C. to about 145° C., or from about 120° C. to about 140° C. The aggregated particle slurry was then used for each subsequent continuous coalescence experimental condition, under different flow and pH conditions. A total of seven slurries were produced by means of continuous coalescence under different conditions. Table 2 shows the fusing test results of seven slurries that were coalesced in continuous mode. Briefly, the continuous coalescence process utilized in producing the examples listed in Table 2 comprised of two heat exchangers used to heat the slurry up to the coalescence temperature, a length of tubing utilized for residence time which was insulated to maintain the coalescence temperature, a single heat exchanger used to cool the slurry to a temperature suitable for pH treatment, a static mixing device wherein the slurry was mixed with an amount of sodium hydroxide solution to a specified pH, and a final single heat exchanger to quench the slurry to below the glass transition temperature of the resin which thereby halts coalescence. The coalesced toner particle slurries were then washed and dried prior to analysis.

TABLE 2

Characterization of Aggregated Slurry Particles Coalesced in Continuous Mode

| Slurry | Gloss at 190° C. | MFT (C80) | MFT (C40) | Cold Offset Temperature ° C. |
|---|---|---|---|---|
| 1 | 39 | 135 | 140 | 130 |
| 2 | 35 | 134 | 139 | 130 |
| 3 | 32 | 137 | 146 | 127 |
| 4 | 36 | 136 | 142 | 130 |
| 5 | 33 | 134 | 140 | 127 |
| 6 | 39 | 134 | 139 | 127 |
| 7 | 36 | 136 | 143 | 127 |

Figure 3:
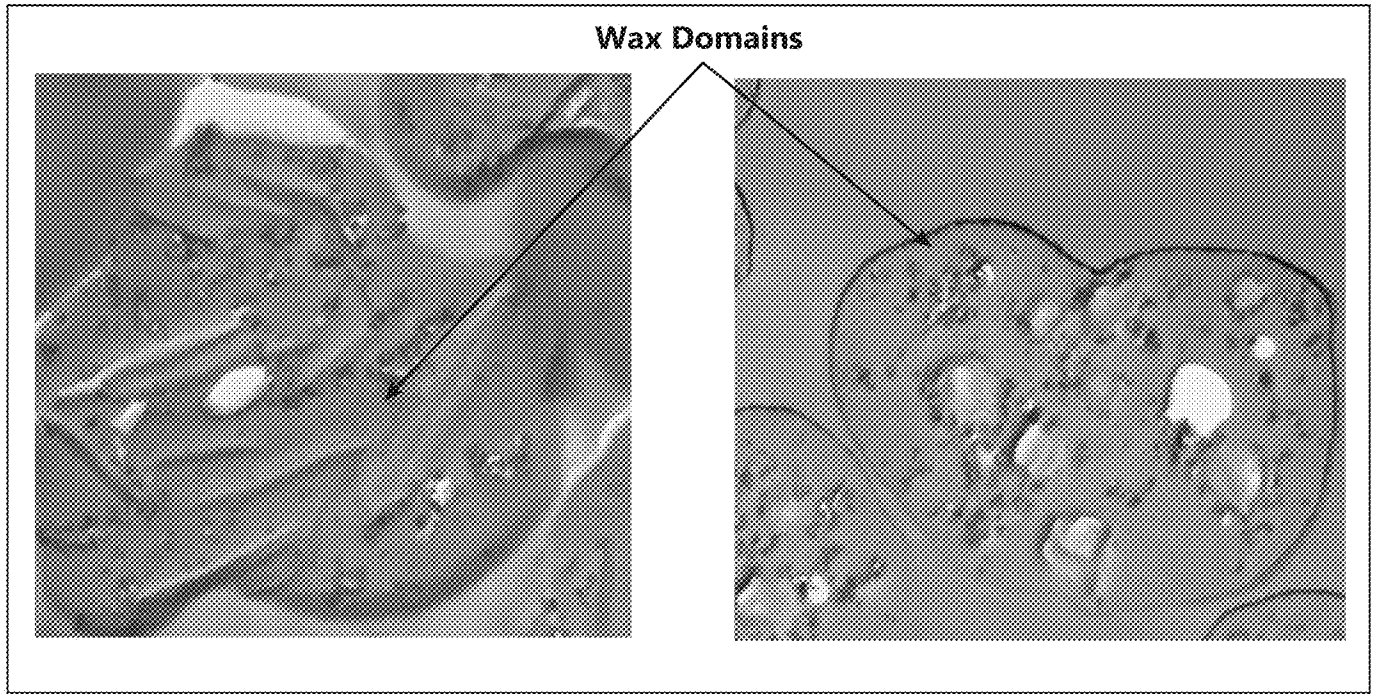
FIG. 3 is a Transmission Electron Microscopy image of two toners of identical composition, one prepared by a batch process (Comparative Example A) and one prepared by the continuous process (Comparative Example 1) described herein, illustrating differing shapes of wax domains therein.

Shown in FIG. 3 are Scanning Electron Micrographs at 3500× magnification of toner particles cross sections. On the left is a toner prepared by the batch process described in Comparative Example A and on the right is a toner of the exact composition by the continuous process described in Example I. As can be seen, the comparative toner on the left exhibits longer and more platelet-shaped domains compared to the toner prepared to the process disclosed herein, which exhibits larger and more spherical wax domains.

A comparison of the results from Comparative Example A versus Comparative Example 1 shows that the gloss of particles made by the continuous coalescence process has a higher gloss than those made from the batch coalescence process. The Minimum Fix Temperature (MFT) for crease area of 80 and 40 show that the particles made by the continuous coalescence process fix to the substrate at a lower temperature than those made by the batch process. These results indicate that the particles made by the continuous coalescence process penetrate the substrate more effective, resulting in improved fix, and also form a more uniform toner layer when the particles are melted in the fusing subsystem within the machine. The more uniform toner layer leads to the higher gloss values observed when the particles are coalesced in continuous mode. It can also be appreciated that the particles coalesced continuously exhibit lower Cold Offset values than those made by the batch process. This result indicates that the particles coalesce in continuous mode can be fused onto the substrate at lower fuser temperatures before toner offset to the fuser roll takes place. In other words. Particles coalesced continuously have a larger fusing latitude than those coalesced in batch mode. FIG. 3 shows Scanning Electron Micrographs at 3500× magnification of toner particles cross sections. On the left is a toner prepared by the batch process described in Comparative Example A and on the right is a toner of the exact composition by the continuous process described in Example I. It can be observed that the shape of the wax domains within the particles is different, depending on the coalescence process. As can be seen, the comparative toner on the left exhibits longer and more platelet-shaped domains compared to the toner prepared to the process disclosed herein, which exhibits larger and more spherical wax domains. In general, spherical wax domains that are not close or protruding through the particle surface are attractive to maintain good toner flow and also to reduce the probability of the toner particles from blocking together and form large particles that could lead to image quality artifacts.

Other embodiments and modifications of the present invention may occur to those of ordinary skill in the art subsequent to a review of the information presented herein; these embodiments and modifications, as well as equivalents thereof, are also included within the scope of this invention.

The recited order of processing elements or sequences, or the use of numbers, letters, or other designations therefor, is not intended to limit a claimed process to any order except as specified in the claim itself.

What is claimed is:

1. A toner composition comprising particles which comprise:

a styrene/n-butylacrylate/β-carboxyethylacrylate copolymer resin having a ratio of styrene monomer to n-butylacrylate monomer to β-carboxyethylacrylate monomer in the copolymer resin from 69 to 90 parts styrene monomer, from 9 to 30 parts n-butylacrylate monomer, and from 1 to 10 parts β-carboxyethylacrylate monomer, wherein the weight average molecular weight of the copolymer resin is from 30,000 to 40,000 and wherein the number average molecular weight of the copolymer resin is from 8,000 to 15,000;

a wax comprising a Fisher Tropsch wax and a paraffin wax, wherein the Fisher Tropsch wax is present in an amount of from 7% to 11% by weight based on the weight of the toner composition, and the paraffin wax is present in an amount of from 1.5% to 2.7% by weight based on the weight of the toner composition; and an optional colorant, wherein the toner particles have a circularity of from about 0.940 to about 0.999, wherein the toner particles contain wax domains having an aspect ratio of from about 1.4 to about 1.8, and wherein the toner particles contain wax domains having a roundness of from about 1.3 to about 1.6.

2. A toner composition according to claim 1 wherein the Fisher Tropsch wax and a paraffin wax constitute a total wax component and wherein the total wax component is present in the toner particles in an amount of from about 10 to about 12 weight percent by the total weight of the toner composition.

3. A toner composition according to claim 1 wherein the toner particles contain a pigment colorant in an amount of from about 5 to about 7 weight percent by the total weight of the toner composition.

4. A toner composition according to claim 1, wherein the toner composition is an emulsion aggregation toner composition.

5. A toner composition comprising:

toner particles having a core and a shell disposed over the core, wherein the core comprises a styrene acrylate resin having a weight average molecular weight from 30,000 to 40,000, wherein the styrene acrylate resin comprises a styrene/n-butylacrylate/β-carboxyethylacrylate copolymer having from about 69 to about 90 parts styrene, from about 9 to about 30 parts n-butylacrylate, and from about 1 to about 10 parts β-carboxyethylacrylate in molar ratio;

two or more wax comprising at least a polymethylene wax and a paraffin wax; and an optional colorant; and wherein the Tg of the core is lower than the Tg of the shell, further wherein the toner particles have a circularity of from about 0.940 to about 0.999, the toner particles contain wax domains having an aspect ratio of from about 1.4 to about 1.8, and the toner particles contain wax domains having a roundness of from about 1.3 to about 1.6.

6. A toner composition according to claim 5, wherein the shell comprises a styrene acrylate copolymer.

7. A toner composition according to claim 5, wherein the shell comprises from about 26 to about 30 percent by weight of the total weight of the shell-covered toner particle.

8. A toner composition according to claim 5, wherein the styrene acrylate resin is present in the toner particles in an amount of from about 82 to about 86 weight percent.

9. A method of forming a toner composition comprising:

(a) forming a slurry comprising particles by preparing an emulsion comprising:

(1) a styrene/n-butylacrylate/β-carboxyethylacrylate copolymer resin having a ratio of styrene monomer to n-butylacrylate monomer to β-carboxyethylacrylate monomer in the copolymer resin from 69 to 90 parts styrene monomer, from 9 to 30 parts n-butylacrylate monomer, and from 1 to 10 parts β-carboxyethylacrylate monomer, wherein the weight average molecular weight of the copolymer resin is from 30,000 to 40,000 and wherein the number average molecular weight of the copolymer resin is from 8,000 to 15,000;

(2) a wax dispersion comprising a Fisher Tropsch wax and a paraffin wax, wherein the Fisher Tropsch wax is present in an amount of from 7% to 11% by weight based on the weight of the toner composition, and the paraffin wax is present in an amount of from 1.5% to 2.7% by weight based on the weight of the toner composition;

(3) optionally a colorant dispersion; and (4) optional additives dispersions;

(b) aggregating particles from the slurry;

(c) optionally adding a second polymer latex and further aggregating the particles to form a shell on the particles;

(d) freezing aggregation of the particles;

(e) preheating the slurry of aggregated particles;

(f) increasing the pH of the slurry of aggregated particles;

(g) coalescing the aggregated particles to form toner particles by continuously passing the aggregated particles through a system comprising at least one heat exchanger;

(h) increasing the pH of the slurry of coalesced toner particles subsequent to passing through the system; and (j) recovering the toner particles from the system, wherein the toner particles have a circularity of from about 0.940 to about 0.999, the toner particles contain wax domains having an aspect ratio of from about 1.4 to about 1.8, and the toner particles contain wax domains having a roundness of from about 1.3 to about 1.6.

10. A method of claim 9, wherein the slurry of aggregated particles is preheated to from about 60° C. to about 70° C.

11. A method of claim 9, wherein the pH of the slurry is increased to from about 4.45 to about 5.50.

12. A method of claim 9, wherein the pH of the slurry of coalesced toner particles is increased to from about 8.7 to about 8.9.

13. A method of claim 9, wherein the freezing of the aggregation of the particles is achieved by adding a solution of NaOH.

* * * * *